US009499366B2

(12) United States Patent
Morikami

(10) Patent No.: US 9,499,366 B2
(45) Date of Patent: Nov. 22, 2016

(54) SHEET FEEDING DEVICE, IMAGE FORMING APPARATUS, AND METHOD FOR CONTROLLING A SHEET FEEDING DEVICE

(71) Applicant: KYOCERA Document Solutions Inc., Osaka (JP)

(72) Inventor: Ayato Morikami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/009,208

(22) Filed: Jan. 28, 2016

(65) Prior Publication Data

US 2016/0221777 A1 Aug. 4, 2016

(30) Foreign Application Priority Data

Jan. 30, 2015 (JP) ..... 2015-017389

(51) Int. Cl.
*B65H 1/00* (2006.01)
*B65H 7/02* (2006.01)
*B65H 1/04* (2006.01)

(52) U.S. Cl.
CPC *B65H 7/02* (2013.01); *B65H 1/04* (2013.01); *B65H 2405/114* (2013.01); *B65H 2405/1116* (2013.01); *B65H 2405/1144* (2013.01); *B65H 2405/11425* (2013.01); *B65H 2511/12* (2013.01); *B65H 2553/21* (2013.01)

(58) Field of Classification Search
CPC ..... B65H 7/02; B65H 7/14; B65H 7/20; B65H 2405/1116; B65H 2405/1144; B65H 2405/114; B65H 2405/11425; B65H 2511/12; B65H 2553/00; B65H 2553/20; B65H 2553/21; B65H 2553/80; B65H 2553/81; B65H 2553/822; B65H 2553/83
USPC ..... 271/171
See application file for complete search history.

(56) References Cited

U.S. PATENT DOCUMENTS 5,332,208 A * 7/1994 Tsuji ..... B65H 1/00 271/171
6,070,048 A * 5/2000 Nonaka ..... B65H 1/00 399/376
6,089,566 A * 7/2000 Xu ..... B65H 29/12 271/171
2008/0122163 A1* 5/2008 Windsor ..... B65H 1/04 271/154
2011/0169215 A1* 7/2011 Oh ..... B65H 1/266 271/227

FOREIGN PATENT DOCUMENTS

JP 2010-208824 A 9/2010

* cited by examiner

*Primary Examiner* — Prasad Gokhale
(74) *Attorney, Agent, or Firm* — Stein IP, LLC

(57) ABSTRACT

A sheet feeding device has cursors slidable to regulate a sheet, a sensor portion including a variable resistor to output a voltage commensurate with the position of the cursors, a storage portion storing width detection data in which ranges of a sensor value based on the output of the sensor portion are defined for different sheet widths respectively, and a control portion calculating the sensor value, determining a particular range as a correction target range, calculating a difference between the actual sensor value and the center value of the correction target range, and correcting a limit value of the correction target range at the border with another range.

9 Claims, 8 Drawing Sheets

FIG.5

| SHEET SIZE (WIDTH) | SENSOR VALUE | IDEAL VALUE (CENTER VALUE) D1 |
|---|---|---|
| ... | ... | ... |
| A4(LONGER SIDE), A3(SHORTER SIDE) | 100≦X<120 | 110 |
| B4(SHORTER SIDE), B5(LONGER SIDE) | 80≦X<100 | 90 |
| A5(LONGER SIDE), A4(SHORTER SIDE) | 60≦X<80 | 70 |
| B5(SHORTER SIDE), B6(LONGER SIDE) | 40≦X<60 | 50 |
| ... | ... | ... |

FIG.6

| SENSOR VALUE | SHEET SIZE (WIDTH) | CUMULATIVE NUMBER OF TIMES D2 |
|---|---|---|
| ... | ... | ... |
| X1 | A4(LONGER SIDE), A3(SHORTER SIDE) | 5 |
| X2 | A4(LONGER SIDE), A3(SHORTER SIDE) | 6 |
| X3 | A4(LONGER SIDE), A3(SHORTER SIDE) | 7 |
| X4 | B5(SHORTER SIDE), B6(LONGER SIDE) | 4 |
| ... | ... | ... |

SHEET FEEDING DEVICE, IMAGE FORMING APPARATUS, AND METHOD FOR CONTROLLING A SHEET FEEDING DEVICE

INCORPORATION BY REFERENCE

This application is based upon and claims the benefit of priority from the corresponding Japanese Patent Application No. 2015-017389 filed on Jan. 30, 2015, the entire contents of which are incorporated herein by reference.

BACKGROUND

The present disclosure relates to a sheet feeding device for feeding sheets, and to an image forming apparatus incorporating a sheet feeding device.

Image forming apparatuses such as multifunction peripherals, copiers, printers, and facsimile machines incorporate a sheet feeding device for feeding placed sheets. The sheet feeding device includes a regulating plate. The regulating plate is slidable to abut opposite edges of sheets in the direction perpendicular to the sheet transport direction. The position of the regulating plate corresponds to sheet width. Thus, with a variable resistor whose knob is interlocked with the regulating plate, the width of placed sheets can be detected. Inconveniently, through repeated sliding, the movable contact and the resistive element inside the variable resistor rub against each other and wear. Thus, as the sheet feeding device continues being used, the variable resistor changes its characteristics, possibly leading to erroneous detection of sheet width.

To cope with the changing characteristics of the variable resistor resulting from the wear of the contact and the resistive element inside it, the following technique is known. In a printing device, the width of sheets fed by a sheet feeder is detected by a variable resistor interlocked with a side fence, and the width of sheets transported through a transport passage is detected by a CIS line sensor; the result of detection by the variable resistor and the result of detection by the CIS line sensor are compared together to determine the sheet width.

For the feeding of sheets to print on, a sheet feeding device such as a manual feed tray or a sheet cassette is incorporated in image forming apparatuses. Image forming apparatuses that has a scanning capability, such as multifunction peripherals, copiers, and facsimile machines, are often provided with a document transporting device for feeding a placed document to the reading position. A document transporting device is considered a kind of sheet feeding device.

A sheet feeding device includes a pair of cursors (also called "regulating plates", "guide members", or "side fences") for aligning, and regulating the position of, placed sheets. The cursors are slidable, and can be moved to abut opposite edges of sheets. This mechanism permits the stack of sheets to be held in a regulated position and the placed sheets to be kept in a proper position. It also helps prevent sheet jams (stuck sheets) and prevent skew in printed or read images.

The cursors are slid to the position that suits the size of placed documents. In a fashion interlocked with the sliding of cursors, a contact inside a variable resistor is moved (the knob position is changed), and thereby the resistance value of the variable resistor is changed. The output voltage value of the variable resistor reflects the cursor position (sheet width). Thus, based on the magnitude of the output voltage value of the variable resistor, the width (size) of placed sheets can be detected. On the other hand, through repeated movement of the cursors, the contact and the resistive element inside the variable resistor keeps wearing; thus the variable resistor changes its characteristics across the ages. Thus, inconveniently, the longer the sheet feeding device is used, the more likely the width of placed sheets is to be detected erroneously.

According to the known technique mentioned above, sheet width is detected not only by a variable resistor but also by a line sensor (CIS image sensor) provided in a transport passage. That is, erroneous detection by the variable resistor is corrected with the result of detection by the line sensor. Unfortunately, this known technique is impractical for the following reasons: (1) it is not applicable to apparatuses having no line sensor; (2) rarely is a line sensor provided in a transport passage in practice; (3) additionally providing a line sensor and a circuit for processing the output of the line sensor increases the production cost of an image forming apparatus; and (4) the need for an expensive line sensor with a resolution high enough to properly correct the result of sheet width detection by a variable resistor further increases the production cost of an image forming apparatus.

SUMMARY

According to one aspect of the present disclosure, a sheet feeding device includes cursors, a sensor portion, a storage portion, and control portion. The cursors are arranged on a sheet tray on which a sheet is placed, and are slidable to abut opposite edges of the placed sheet to regulate position of the sheet. The sensor portion includes a variable resistor, and outputs a voltage commensurate with the position of the cursors. The storage portion stores width detection data in which are stored, for different standard sheet widths respectively, ranges of a sensor value which is a value commensurate with the level of the output of the sensor portion and which is obtained based on the output of the sensor portion. The control portion processes the output voltage of the sensor portion to obtain the sensor value; performs sheet width detection to detect the placement of a sheet of a width corresponding to one of the ranges to which the sensor value belongs; makes the storage portion store the sensor value obtained during the sheet width detection; takes as a correction target range one of the ranges corresponding to, out of different standard sheet widths, the sheet width that has been detected a number of times equal to a natural number times a predetermined number of times; calculates the difference between the sensor value as actually obtained and the center value of the correction target range; and corrects the upper or lower limit value of the correction target range at the border with another range.

Further features and advantages of the present disclosure will become apparent from the description of embodiments given below.

BRIEF DESCRIPTION OF THE DRAWINGS

FIG. 5 is a diagram showing one example of width detection data according to one embodiment;

FIG. 6 is a diagram showing one example of stored sensor value data in a manual sheet feeding device according to one embodiment;

DETAILED DESCRIPTION

According to the present disclosure, it is possible, without the provision of an expensive component such as an image sensor, to prevent erroneous detection of sheet width in a sheet feeding device that includes a variable resistor that has notably worn through use for a long period. According to the present disclosure, it is also possible to detect sheet width accurately. Hereinafter, one embodiment of the present disclosure will be described with reference to FIGS. 1 to 10. The following description takes, as an example, a multifunction peripheral 100 (corresponding to an image forming apparatus) that includes a sheet feeding device 1. None of the features of the embodiment in terms of structure, arrangement, etc. is meant to restrict the scope of the present disclosure; they are all merely illustrative.

(Overview of an Image Forming Apparatus)

First, with reference to FIG. 1, an outline of a multifunction peripheral 100 according to one embodiment of the present disclosure will be described.

Figure 1:
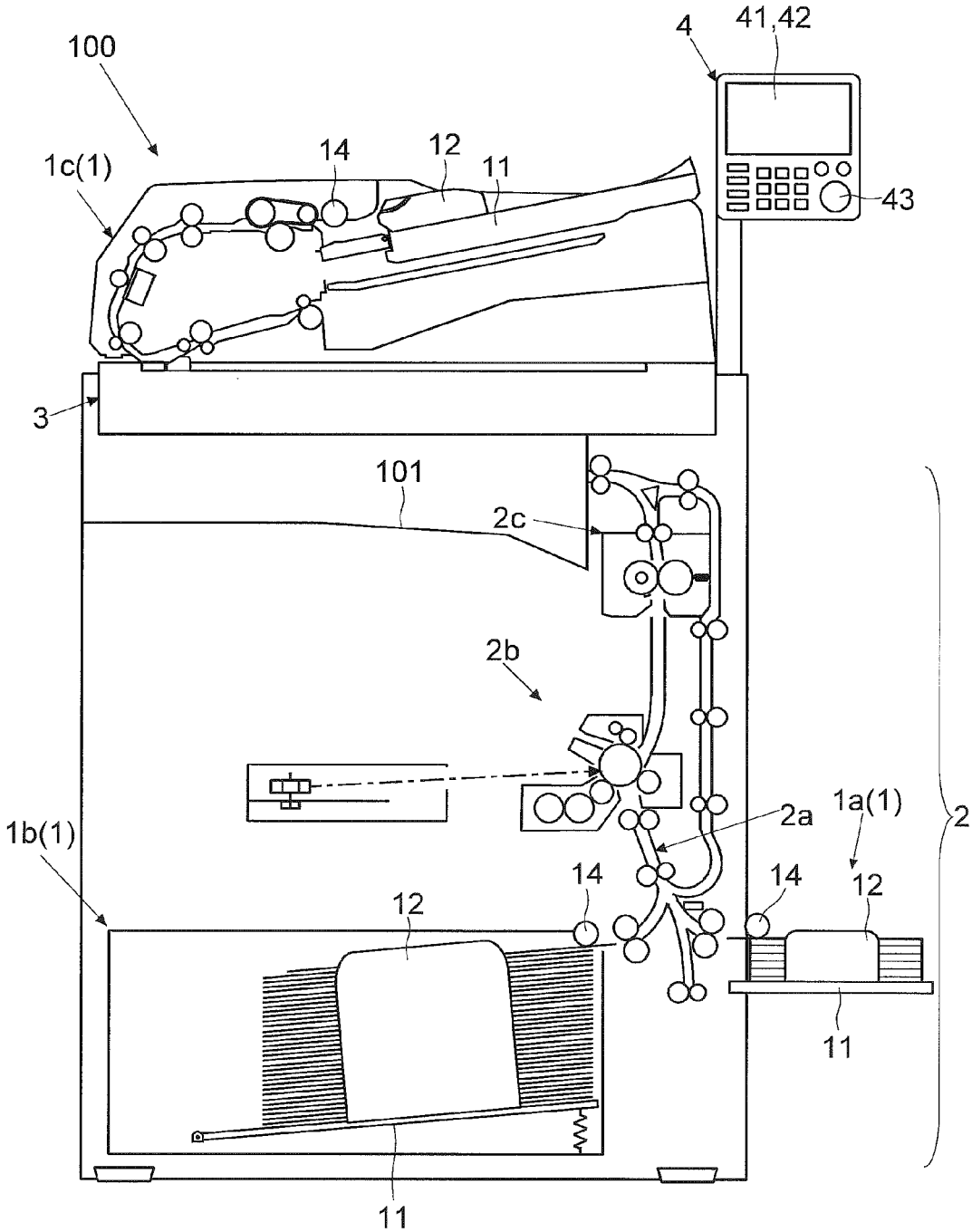
FIG. 1 is a diagram showing a multifunction peripheral according to one embodiment.

As shown in FIG. 1, the multifunction peripheral 100 according to the embodiment has a printing section 2, which includes a sheet feeding device 1 (a manual sheet feeding device 1*a* and a cassette sheet feeding device 1*b*), a transport portion 2*a*, an image forming portion 2*b*, and a fixing portion 2*c*. The multifunction peripheral 100 further has, in an upper part thereof, a document transport portion 1*c* (corresponding to a sheet feeding device 1) and an image reading section 3. The multifunction peripheral 100 also has an operation panel 4.

The document transport portion 1*c* transports a placed document, one sheet after another, toward a reading position continuously and automatically. The image reading section 3 reads a document transported by the document transport portion 1*c*, or a document placed on a stationary-reading contact glass (unillustrated), to generate image data.

The operation panel 4 includes a display panel 41, a touch panel portion 42, and hardware keys such as a Start key 43. The display panel 41 displays setting screens related to printing and document reading, messages (such as alerts, error indications, and status indications), etc. The operation panel 4 accepts job settings as to conditions for and functions used in a print job and a transmission job. The operation panel 4 also allows choice of from which sheet feeding device 1, i.e., the cassette sheet feeding device 1*b* (corresponding to a sheet feeding device 1) or the manual sheet feeding device 1*a* (corresponding to a sheet feeding device 1), to feed sheets. The manual sheet feeding device 1*a* and the cassette sheet feeding device 1*b* can each contain a plurality of sheets; during printing, one of the sheet feeding devices 1 feeds out sheets.

The transport portion 2*a* guides a sheet fed from the sheet feeding device 1 or the manual sheet feeding device 1*a* to the image forming portion 2*b*. The image forming portion 2*b* forms a toner image based on image data, and transfers it to the sheet. The fixing portion 2*c* heats and presses the sheet having the toner image transferred to it, and thereby fixes the toner image to the sheet. After the fixing, the sheet is discharged onto a discharge tray 101.

Hardware Configuration of the Multifunction Peripheral 100

Next, with reference to FIG. 2, the hardware configuration of the multifunction peripheral 100 will be described.

Figure 2:
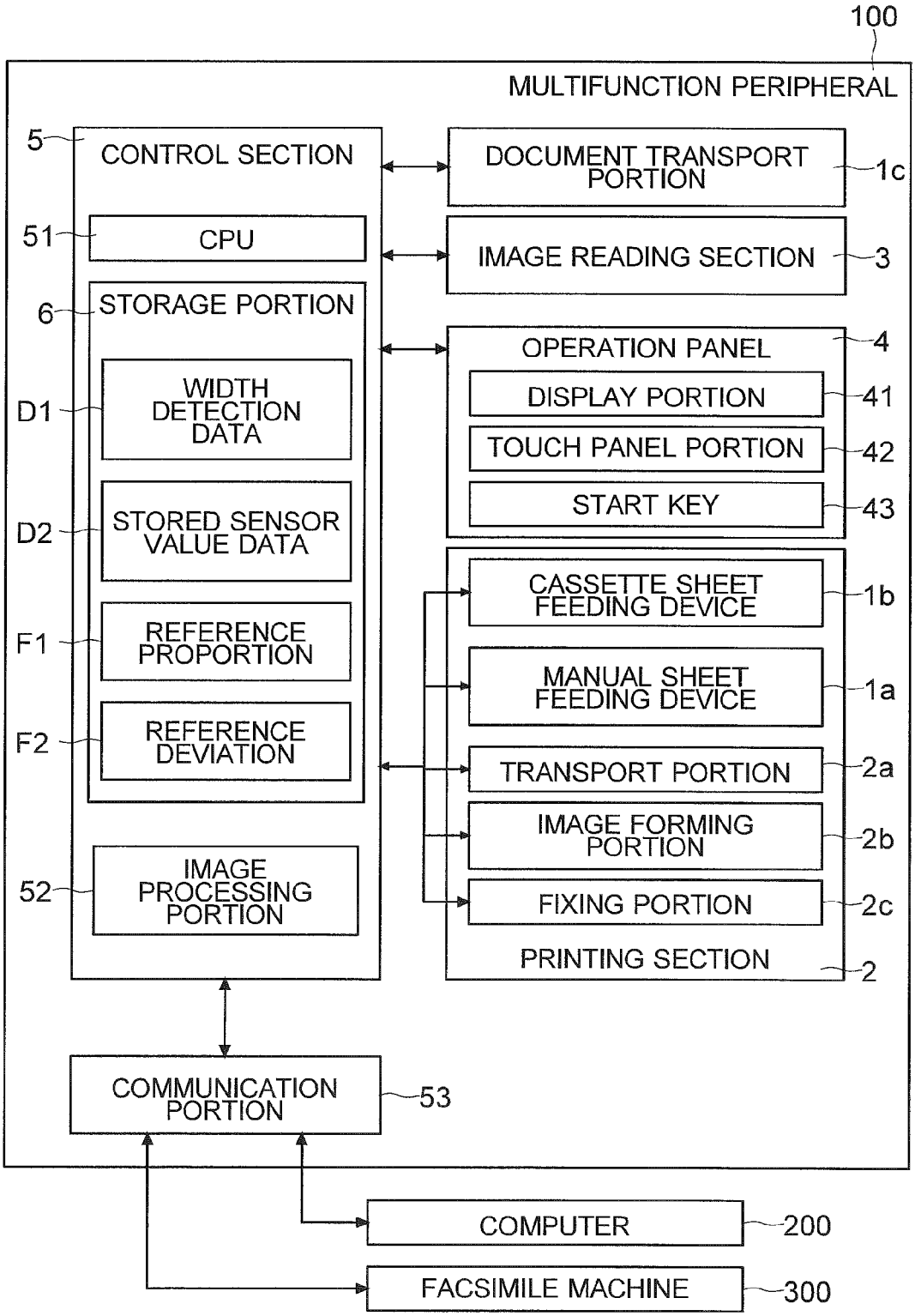
FIG. 2 is a diagram showing a hardware configuration of a multifunction peripheral according to one embodiment.

As shown in FIG. 2, the multifunction peripheral 100 includes a control section 5 inside it. The control section 5 controls different blocks in the apparatus. The control section 5 includes a CPU 51, an image processing portion 52 for generating image data to be used for printing and transmission, and other circuits and devices.

The CPU 51 performs data processing and controls different blocks in the multifunction peripheral 100 based on control programs and control data stored in a storage portion 6. The storage portion 6 comprises a combination of a nonvolatile storage device such as ROM, flash ROM, or a HDD and a volatile storage device such as RAM.

The control section 5 is communicably connected to different blocks (the cassette sheet feeding device 1*b*, the manual sheet feeding device 1*a*, the transport portion 2*a*, the image forming portion 2*b*, and the fixing portion 2*c*) in the printing section 2. The control section 5 gives instructions to different blocks in the printing section 2 which performs sheet feeding, sheet transport, toner image formation, transfer, and fixing so that image formation may be performed properly. An engine control portion which actually controls the printing section 2 may be provided separately from the control section 5, in which case the control section 5 gives instructions to the engine control portion to control the operation of the printing section 2. The control section 5 can make the printing section 2 perform printing based on image data acquired by the image reading section 3 reading a document (a copier function).

To the control section 5 is connected a communication portion 53. The communication portion 53 is an interface for communication with a computer 200, such as a personal computer or a server, or a facsimile machine 300 via a network or a cable. The control section 5 makes the printing section 2 perform printing based on print data (image data and print settings) that the communication portion 53 receives from the computer 200 (a printer function). The communication portion 53 can also transmit image data to the computer 200 or the facsimile machine 300 (a transmitter function).

The control section 5 is communicably connected to the image reading section 3 and the document transport portion 1*c*. The control section 5 gives operation instructions to the image reading section 3 and the document transport portion 1*c*, which then operate as instructed.

The control section 5 controls what is displayed on the operation panel 4. The control section 5 recognizes settings made and instructions entered by a user operating the touch panel portion 42 and the hardware keys such as the Start key 43, and controls the printing section 2, the image reading section 3, and the document transport portion 1 c to make these execute jobs according to the user's instructions.

Sheet Feeding Device 1

Figure 3:
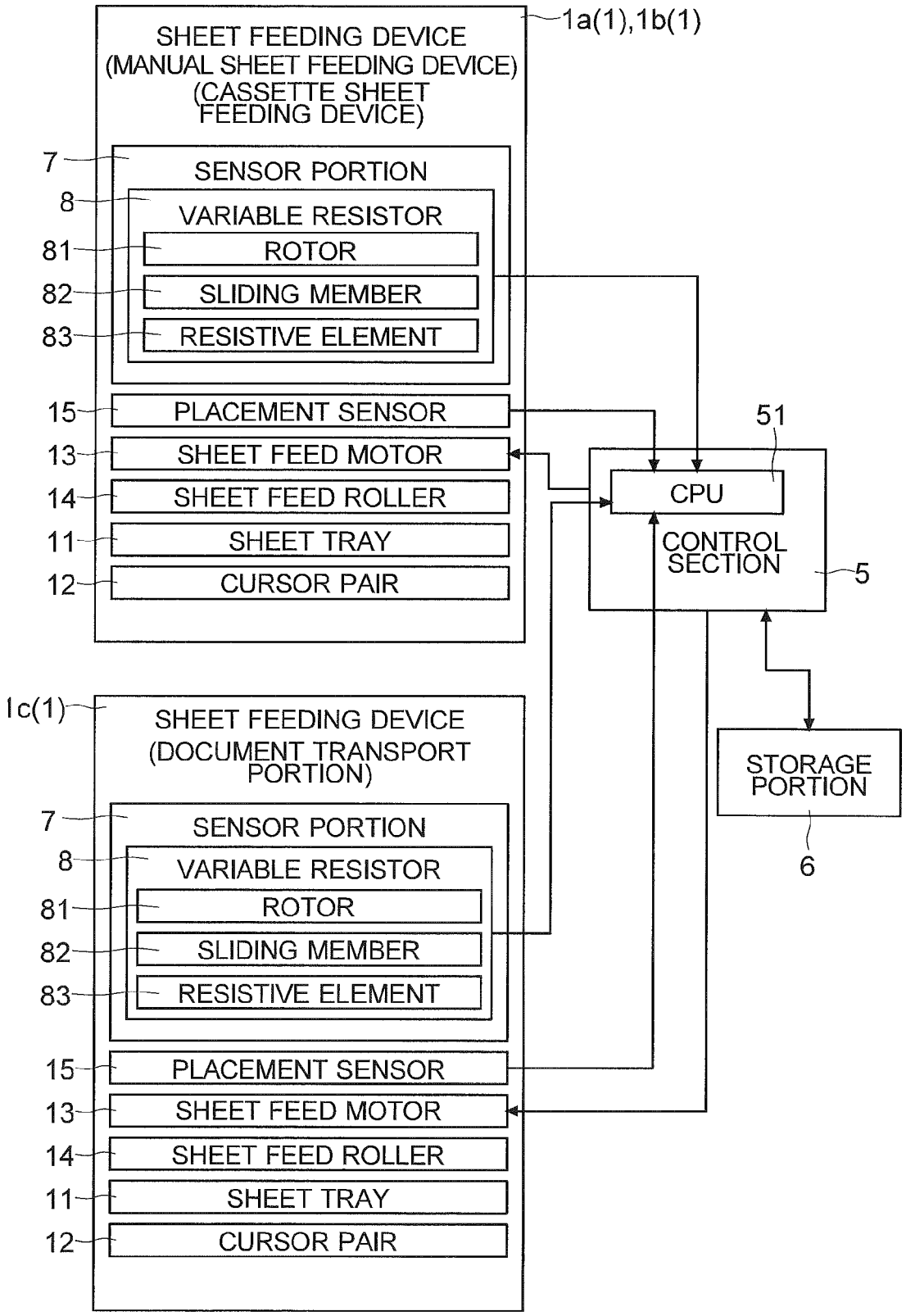
FIG. 3 is a diagram showing blocks related to a sheet feeding device according to one embodiment.

Next, with reference to FIG. 3, a sheet feeding device 1 included in the multifunction peripheral 100 according to the embodiment will be described.

The multifunction peripheral 100 includes, as a sheet feeding device 1, the manual sheet feeding device 1*a* and the cassette sheet feeding device 1*b*. The document transport portion 1*c*, which transports a placed document to a reading position, also is a kind of sheet feeding device 1. Thus, the multifunction peripheral 100 includes at least three sheet feeding devices 1.

Each sheet feeding device 1 includes, at least, a sheet tray 11, a cursor pair 12, a sheet feed motor 13, a sheet feed roller 14, a sensor portion 7, and a placement sensor 15. In all the sheet feeding devices 1 (the manual sheet feeding device 1*a*, the cassette sheet feeding device 1*b*, and the document transport portion 1*c*), the sheet tray 11, the cursor pair 12, the sheet feed motor 13, the sheet feed roller 14, and the sensor portion 7 respectively serve the same function; accordingly, in the following description, they are identified by common reference signs.

The sheet tray 11 is box-shaped, and its top face serves as a placement surface on which to place a sheet (see FIG. 1). In the cassette sheet feeding device 1*b* and the manual sheet feeding device 1*a*, a sheet on which the print is placed on the sheet tray 11. In the document transport portion 1*c*, a document (sheet) to be read is placed on the sheet tray 11. In each sheet feeding device 1, the sensor portion 7 is provided inside the sheet tray 11.

The cursor pair 12 is provided on the sheet tray 11. The cursor pair 12 includes a pair of regulating plates 12*a*, and the cursors are each slidable in the direction perpendicular to the sheet transport direction (i.e., in the width direction of sheets) (see FIG. 4). The regulating plates 12*a* are so moved as to abut, from opposite sides, sheets or a document placed on the sheet tray 11 so as to regulate the position of the placed sheets. In other words, the cursor pair 12 regulates the position of sheets by abutting them from opposite sides.

As the sheet feed roller 14 rotates, it feeds out sheets placed on the sheet tray 11. The sheet feed motor 13 makes the sheet feed roller 14 rotate to feed out sheets. When sheets are fed from the cassette sheet feeding device 1*b*, the control section 5 makes the sheet feed motor 13 of the cassette sheet feeding device 1*b* rotate. When sheets are fed from the manual sheet feeding device 1*a*, the control section 5 makes the sheet feed motor 13 of the manual sheet feeding device 1*a* rotate. When sheets (a document) are fed from the document transport portion 1*c*, the control section 5 makes the sheet feed motor 13 of the document transport portion 1*c* rotate.

The sensor portion 7 is a sensor for detecting the width of sheets placed on the sheet tray 11. The sensor portion 7 includes a variable resistor 8, and outputs a voltage that reflects the position of the cursors. Based on the output from the sensor portion 7 in the cassette sheet feeding device 1*b* or the manual sheet feeding device 1*a*, the control section 5 detects the width of sheets placed on the cassette sheet feeding device 1*b* or the manual sheet feeding device 1*a*. Based on the output from the sensor portion 7 provided in the document transport portion 1*c*, the control section 5 detects the width of sheets placed on the sheet tray 11 of the document transport portion 1*c*.

The placement sensor 15 is a sensor for detecting whether or not a sheet is placed on the sheet tray 11. The placement sensor 15 can comprise an optical sensor, and its output voltage value varies greatly depending on whether or not a sheet is placed. Based on the output value from the placement sensor 15 of the cassette sheet feeding device 1*b* or the manual sheet feeding device 1*a*, the control section 5 detects whether or not a sheet is placed on the cassette sheet feeding device 1*b* or the manual sheet feeding device 1*a*. Based on the output value from the placement sensor 15 provided in the document transport portion 1*c*, the control section 5 detects whether or not a document is placed on the sheet tray 11 of the document transport portion 1*c*.

Sheet Width Detection

Figure 4:
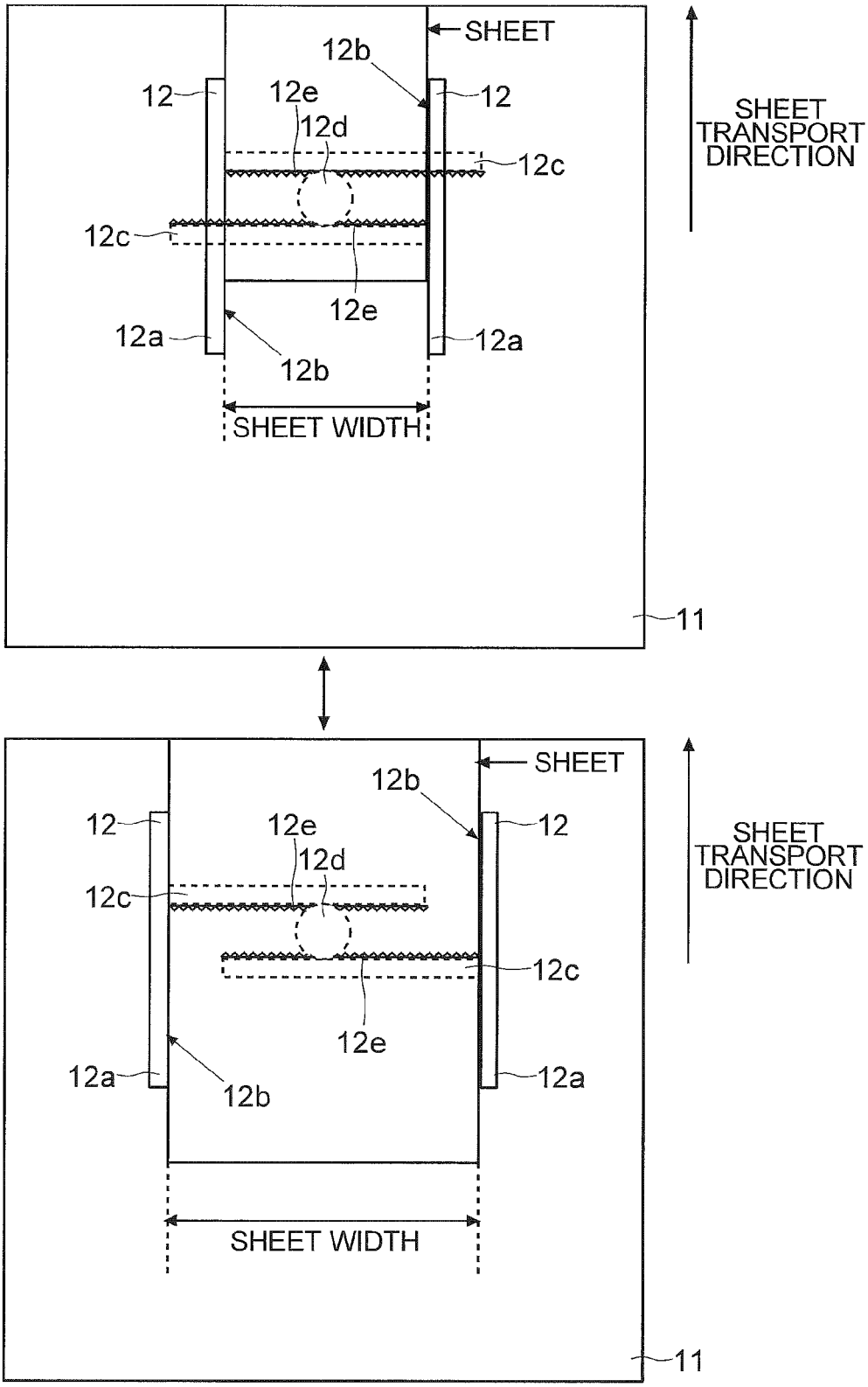
FIG. 4 is a diagram showing one example of positions of cursors for different sheet widths.

Next, with reference to FIGS. 4 and 5, a description will be given of sheet width detection in the sheet feeding device 1 according to the embodiment. FIG. 4 is a diagram showing one example of positions of the cursor pair 12 for different sheet widths. FIG. 5 is a diagram showing one example of width detection data D1 in the embodiment.

In the multifunction peripheral 100, the width of placed sheets is detected with predetermined detection timing.

For a job involving printing, such as a copy job, when an operation for starting the execution of the copy job (an operation of pressing the Start key 43) is made on the operation panel 4 with the manual sheet feeding device 1*a* selected as a sheet feed source according to a setting made on the operation panel 4, the control section 5 detects the width of the sheets placed on the manual sheet feeding device 1*a*. When an operation for starting the execution of the copy job is made on the operation panel 4 with the cassette sheet feeding device 1*b* selected as a sheet feed source according to a setting made on the operation panel 4, the control section 5 detects the width of the sheet placed on the cassette sheet feeding device 1*b*. When an operation for starting the execution of the copy job (an operation of pressing the Start key 43), or an operation for starting the execution of a job involving scanning but not printing, such as a scan-and-send job (an operation of pressing the Start key 43), is made on the operation panel 4, the control section 5 detects the width of the sheets placed on the document transport portion 1*c*.

The control section 5 may detect the width of placed sheets, instead of when an operation for starting a job (an operation of pressing the Start key 43) is made, but when a type of job (function) to be executed, such as copy or scan-and-send, is selected. The control section 5 can detect sheet width on whichever sheet feeding device 1 is recognized to have sheets newly placed on it based on the output from the placement sensor 15.

FIG. 4 is a view of the sheet tray 11 from above. On the top face of the sheet tray 11 is provided the cursor pair 12. Thus, the regulating plates 12*a* (cursors) are provided on the sheet tray 11. The regulating plates 12*a* are plate-form members which are arranged upright, parallel to the sheet transport direction and perpendicularly to the sheet tray 11.

The cursors each slide in the direction perpendicular to the sheet transport direction. The inner faces of the regulating plates 12*a* (the faces at which the regulating plates 12*a* face each other) abut opposite sides of sheets (opposite edges of sheets in the width direction) placed on the sheet tray 11. The cursors are moved to suit the size (width) of the placed sheets so that the sheets remain in position. In this way, the position of the placed sheets can be regulated. Sheets can then be fed out without skew. In the lower half of FIG. 4 is shown a state where sheets with a larger width than in the upper half of FIG. 4 are placed. As shown in FIG. 4, the cursors change position (the interval between the regulating plates 12*a* varies) according to the width of the sheets placed.

Under the cursors (regulating plates 12*a*), interlocking members 12*c* are respectively provided which are plate-form members of which the length direction runs in the direction perpendicular to the sheet transport direction. For example, the interlocking members 12*c* are fitted to the regulating plates 12*a* to be perpendicular to them. The interlocking members 12*c* are located inside the sheet tray 11. The two interlocking members 12*c* are located at displaced positions in the sheet transport direction. In FIG. 4, the left-hand interlocking member 12*c* is located upstream of the right-hand interlocking member 12*c* with respect to the sheet transport direction.

At the middle position between the inner faces of the regulating plates 12*a*, between the respective interlocking members 12*c* of the cursors (regulating plates 12*a*), there is provided a rotary member 12*d*. The rotary member 12*d* is rotatable about a rotation axis running in the direction perpendicular to the placement surface of the sheet tray 11. The rotary member 12*d* has cogs formed on its circumferential face. The interlocking member 12*c* of each cursor has, at the rotary member 12*d* side one of its opposite edges extending in the direction perpendicular to the sheet transport direction, a cogged face 12*e*. The interlocking members 12*c* are so located that the cogged face 12*e* of the interlocking member 12*c* of each cursor meshes with the cogs of the rotary member 12*d*.

Owing to the cogged face 12*e* of each interlocking member 12*c* being meshed with the rotary member 12*d*, as one cursor is moved, the other moves in an interlocked fashion. As one cursor is moved inward, the other also moves inward; as one cursor is moved outward, the other also moves outward. No matter what size the sheets placed on the sheet tray 11 are, the cursors move such that the middle of the width of the sheets coincides with the middle of the sheet transfer passage in the width direction (middle-aligned sheet feeding).

Inside the sheet tray 11, the sensor portion 7 is provided. The sensor portion 7 includes a variable resistor 8 (a so-called rotary position sensor). The variable resistor 8 includes a rotor 81 (knob), a sliding member 82 which moves as the rotor 81 is rotated, and a resistive element 83 (see FIG. 3). The sliding member 82 is electrically conductive, and at one end makes contact with the resistive element 83. The variable resistor 8 has three terminals, of which one is connected to one end of the resistive element 83, another is connected to the other end of the resistive element 83, and the third is connected to the other end of the sliding member 82. From this, last-mentioned, terminal, an output voltage is derived.

The rotor 81 is coupled to the rotary member 12*d*. Thus, as the cursor pair 12 is moved, the rotary member 12*d* rotates, and the rotor 81 rotates together, changing its angle. That is, with the rotation of the rotary member 12*d* accompanying the sliding of the cursor pair 12, the knob position of the variable resistor 8 changes. As the rotation angle of the rotor 81 changes, the position at which the other end of the sliding member 82 makes contact with the resistive element 83 changes, causing the voltage division ratio of the resistive element 83 to change. The output voltage value of the variable resistor 8 changes as the cursors are moved. The level of the output voltage of the variable resistor 8 depends on the position of the cursors.

Among the manual sheet feeding device 1*a*, the cassette sheet feeding device 1*b*, and the document transport portion 1*c*, different as the height of the regulating plate 12*a* may be, the same interlocking member 12*c*, the same rotary member 12*d*, and the same sensor portion 7 ("the same" denoting having t specifications) can be used. Different interlocking members 12*c*, different rotary members 12*d*, or different sensor portions 7 may be used in different sheet feeding devices 1.

The output value of the variable resistor 8 in each of the cassette sheet feeding device 1*b*, the manual sheet feeding device 1*a*, and the document transport portion 1*c* is fed to the control section 5 (to the CPU 51 in it). The CPU 51 includes an AD conversion circuit, and the control section 5 performs ND conversion on the output voltage value from each variable resistor 8 to obtain digital values. An AD conversion circuit may be provided outside the CPU 51, in which case the CPU 51 receives the digital values resulting from conversion by the AD conversion circuit, thereby to recognize the output voltage value from each sensor portion 7 (variable resistor 8).

The control section 5 processes the output voltage value from the variable resistor 8 in each sheet feeding device 1, and calculates, for each sheet feeding device 1, a sensor value which indicates the magnitude of the output voltage value from the variable resistor 8. The control section 5 multiplies the output voltage value from the variable resistor 8 in the manual sheet feeding device 1*a* by a coefficient for the manual sheet feeding device 1*a* to calculate a sensor value for the manual sheet feeding device 1*a*. The control section 5 multiplies the output voltage value from the variable resistor 8 in the manual sheet feeding device 1*b* by a coefficient for the manual sheet feeding device 1*b* to calculate a sensor value for the manual sheet feeding device 1*b*. The control section 5 multiplies the output voltage value from the variable resistor 8 in the manual sheet feeding device 1*c* by a coefficient for the manual sheet feeding device 1*c* to calculate a sensor value for the manual sheet feeding device 1*c*.

As described above, based on the output value from the variable resistor 8 provided in each sheet feeding device 1, the sensor value for that sheet feeding device 1 is calculated. The storage portion 6 stores width detection data D1 in which are defined, for different widths of standard sheets as detection targets respectively, ranges of the sensor value which indicates the level of the output of the sensor portion 7 as calculated based on the output of the sensor portion 7.

FIG. 5 shows one example of the width detection data D1 for the manual sheet feeding device 1*a*. As shown in FIG. 5, in the width detection data D1 are defined ranges of the sensor value for different widths of standard sheets. In the example shown in FIG. 5, the range for A4 (longer side) and A3 (shorter side) is defined as $100 \leq X < 120$. The limit values of the range corresponding to A4 (longer side) and A3 (shorter side) are 120 at the upper limit and 100 at the lower limit. Although FIG. 5 shows an example for A- and B-series sheets, the width detection data D1 contains also data for inch-based sheets, such as letter size.

The ranges in the detection data D1 are adjusted at the stage of shipment of the multifunction peripheral 100. For example, standard sheets of a given width defined in the width detection data D1 are placed a plurality of times, and each time they are placed, the sensor value is obtained. At the start of use, when the variable resistor 8 has hardly worn, obtaining the sensor value for the same width a plurality of times yields approximately equal values. Then the average value of the obtained sensor values is calculated. A range for the given width is then determined such that the average value is the center value of the range.

The width detection data D1 may be prepared separately for each of the manual sheet feeding device 1*a*, the cassette sheet feeding device 1*b*, and the document transport portion 1*c*. Instead, the width detection data D1 may be common to all the sheet feeding devices 1, in which case the coefficients by which the output voltage value from the variable resistor 8 is multiplied can be adjusted for each of the different sheet feeding devices 1.

When detecting sheet width in the manual sheet feeding device 1*a*, the control section 5 recognizes the sensor value of the variable resistor 8 in the manual sheet feeding device 1*a*, finds out the range in which the sensor value falls, and thereby detects that sheets of the width corresponding to the range found are placed. Likewise, when detecting sheet width in the manual sheet feeding device 1*b*, the control section 5 recognizes the sensor value of the variable resistor 8 in the manual sheet feeding device 1*b*, finds out the range in which the sensor value falls, and thereby detects that sheets of the width corresponding to the range found are placed. Likewise, when detecting the sheet width in the manual sheet feeding device 1*c*, the control section 5 recognizes the sensor value of the variable resistor 8 in the manual sheet feeding device 1*c*, finds out the range in which the sensor value falls, and thereby detects that sheets of the width corresponding to the range found are placed.

Correction of Width Detection Data D1

Next, with reference to FIGS. 6 to 10, a description will be given of correction of width detection data D1.

Width detection data D1 can be corrected in a similar manner with respect to the width detection data D1 for the manual sheet feeding device 1*a*, the width detection data D1 for the cassette sheet feeding device 1*b*, and the width detection data D1 for the document transport portion 1*c*. The following description deals with a procedure for correcting the width detection data D1 for the manual sheet feeding device 1*a*. Correction can be performed through a similar procedure for other sheet feeding devices 1.

First, in preparation for the correction of the width detection data D1 for the manual sheet feeding device 1*a*, the control section 5 stores in the storage portion 6 the sensor value obtained when width detection is performed with respect to the manual sheet feeding device 1*a*. FIG. 6 shows one example of stored sensor value data D2 for the manual sheet feeding device 1*a*. The control section 5 stores, in the storage portion 6, the sensor value obtained when sheet width detection is performed with predetermined timing with respect to the manual sheet feeding device 1*a*, as stored sensor value data D2 (see FIG. 2). The control section 5 also stores in the stored sensor value data D2 the result (sheet size, sheet width) of detection of the sheet width corresponding to the sensor value. The control section 5 further adds to the stored sensor value data D2, for each of different widths of standard sheets, the cumulative number of time that such sheets have been detected thus far.

Then the control section 5 determines, as a correction target range E1, the range corresponding to, out of the standard sheet widths detected in the manual sheet feeding device 1*a*, the sheet width that has been detected a number of times equal to a natural number times a predetermined number of times. The predetermined number of times can be determined arbitrarily (e.g., 10 times).

Figure 7:
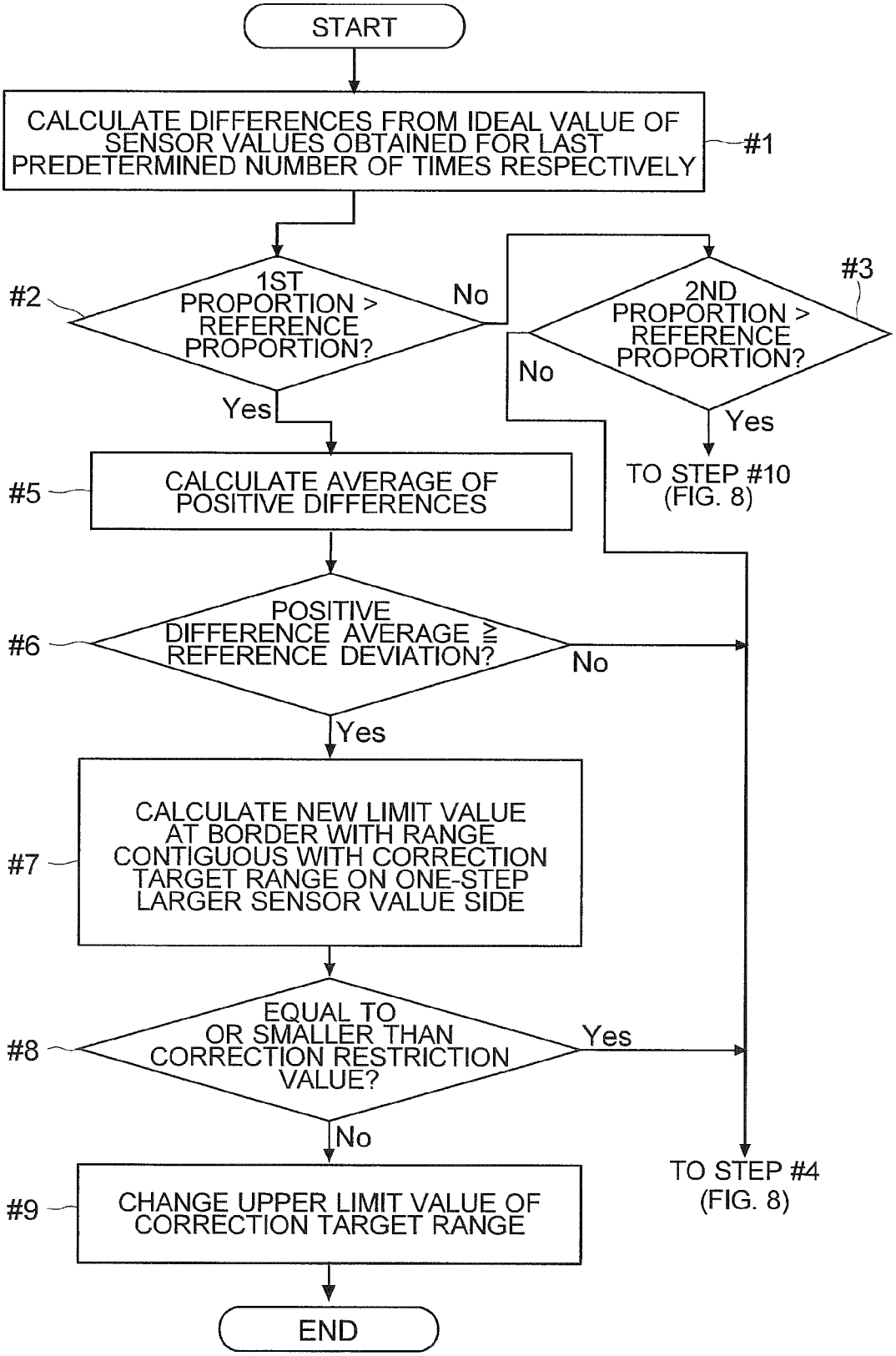
FIGS. 7 and 8 are flow charts showing one example of a procedure for correcting width detection data according to one embodiment.
Figure 8:
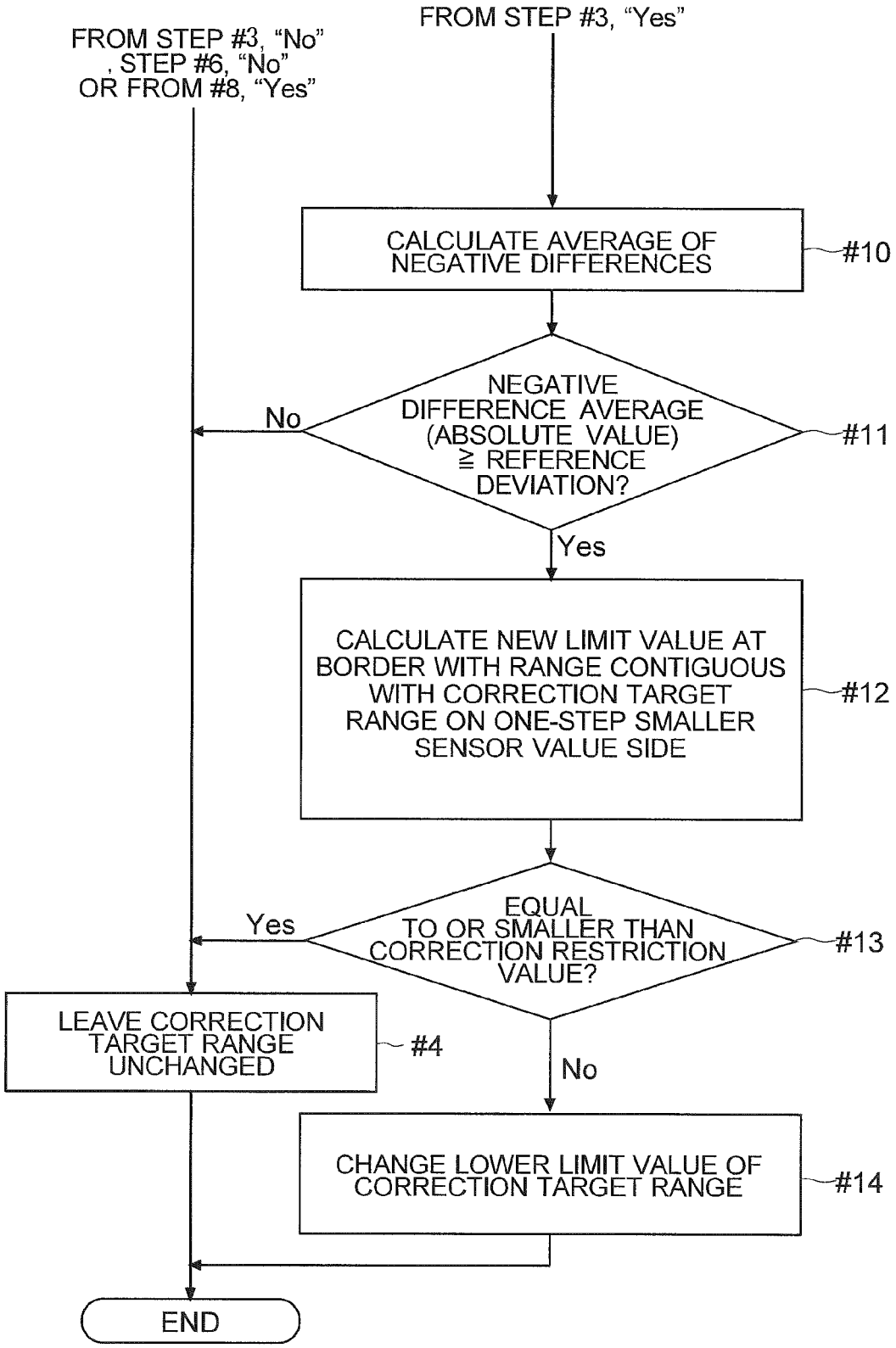

The procedure in FIG. 7 starts when the correction target range E1 is determined. In a case where sheet width detection is performed when an operation for starting the execution of a job (an operation of pressing the Start key 43) is made, the procedure in FIG. 7 starts when the Start key 43 is pressed. In a case where sheet width detection is performed when a kind of job (function) to be executed is selected, the procedure in FIG. 7 starts when a kind of job (function) to be executed is selected. In a case where sheet width detection is performed when sheets are placed, the procedure in FIG. 7 starts when sheets are newly placed on the manual sheet feeding device 1*a*.

The following description deals with a configuration corresponding to FIG. 5, where the larger the width of placed sheets, the larger the sensor value.

First, for each of the sensor values obtained when placement of sheets of the width corresponding to the correction target range E1 was detected for a last predetermined number of times, the control section 5 subtracts the center value from the sensor value, eventually obtaining a plurality of differences (Step #1). In a case where the predetermined number equals 10, the control section 5 sorts out the sensor values obtained when a value within the correction target range E1 was detected for the last (previous) 10 times, and calculates (10) differences respectively.

Subsequently, the control section 5 checks whether or not a first proportion, which is calculated by dividing the number of positive differences by the predetermined number of times, is higher than a prescribed reference proportion F1 (Step #2). This is to see when the obtained output values tend to be larger than the center value. When the tendency is observed, the control section 5 corrects the correction target range E1. The reference proportion F1 is a value that can be determined arbitrarily; for example, it can be larger than 50%, and can be set at a value between 60% and 100%.

When the reference proportion F1 is not exceeded (Step #2, No), the control section 5 then checks whether or not a second proportion, which is calculated by dividing the number of negative differences by the predetermined number of times, is higher than the prescribed reference proportion F1 (Step #3). When the second proportion too does not exceed the reference proportion F1 (Step #3, No), the control section 5 ends the procedure without correcting the correction target range E1 (from Step #4 to End). In this case, the sensor values are not considered to be distributed unevenly with respect to the center value. Accordingly, the procedure is ended without the limit values of the correction target range E1 corrected (with no change in the range).

When the first proportion is higher than the reference proportion F1 (Step #2, Yes), the control section 5 calculates the average value of the positive differences (Step #5). The control section 5 then checks whether or not the average value of the positive differences is equal to or larger than a prescribed reference deviation F2 (Step #6). When it is smaller than the reference deviation F2 (Step #6, No). the control section 5 ends the procedure without correcting the correction target range E1 (from Step #4 to End). The reference deviation F2 can be determined arbitrarily, and is a reference deviation with reference to which to determine whether or not to correct the limit values of the correction target range E1. When the deviation from the center value is so small as to fall below the reference deviation, erroneous detection of sheet width is unlikely. In this case, the range does not need to be corrected. On the other hand, when the average value of the positive differences is equal to or larger than the reference deviation F2 (Step #6, Yes), the control section 5 determines a new limit value at the border with the range that is contiguous with the correction target range E1 on the one-step larger sensor value side (i.e., on the upper limit side) (Step #7; details will be given later; see FIG. 9).

The control section 5 then checks whether or not the absolute value of the difference between the center value of the correction target range E1 with the new limit value applied to it and the center value of the range contiguous with it on the side to which the limit value is moved (i.e., the upper side) is equal to or smaller than a prescribed correction restriction value (Step #8). This is to avoid giving the correction target range E1 or a range contiguous with it an excessively small width.

When the absolute value is not equal to or smaller than the correction restriction value (Step #8, No), the control section 5 makes the storage portion 6 change the limit value in the width detection data D1 such that the upper limit value of the correction target range E1 equals the new limit value (Step #9). This ends the procedure (End). On the other hand, when the absolute value is equal to or smaller than the correction restriction value (Step #8, Yes), the control section 5 ends the procedure without correcting the correction target range E1 (from Step #4 to End).

Specifically, the control section 5 determines as the new upper limit value of the correction target range E1 one-half of the sum of the value obtained by adding the average value of the positive differences to the current center value of the correction target range E1 and the center value of the range that is contiguous with the correction target range E1 on the one-step larger sensor value side.

Figure 9:
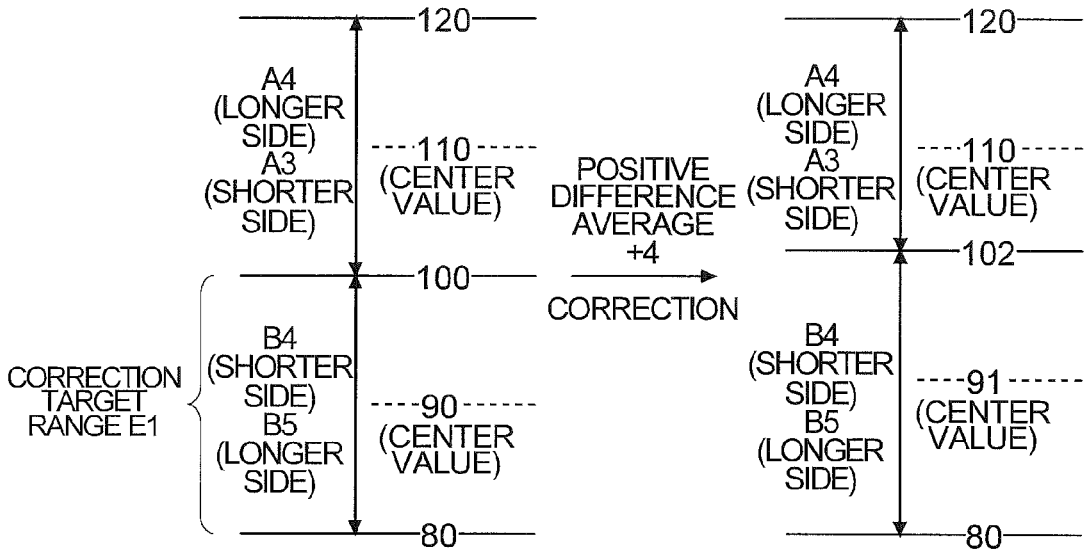
FIG. 9 is a diagram showing one example of shifting of a limit value according to one embodiment.

This will now be described with reference to FIG. 9. In the example shown in FIG. 9, the correction target range E1 is the range corresponding to B4 (shorter side) and B5 (longer side). It is assumed that the correction target range E1 has a sensor value of 80 as the lower limit value, a sensor value of 100 as the upper limit value, and a center value of 90, and that the average value of positive differences is calculated as +4. First, the control section 5 adds the average value of the positive differences, +4, to the current center value of the correction target range E1, 90, to obtain 94. Subsequently, the control section 5 adds up the obtained value, 94, and the center value of the range (shorter side of A3, longer side of A4) contiguous with the correction target range E1 on the one-step larger sensor value side, 110, to obtain 204. The control section 5 then halves the sum to determine the result, 102, as the corrected limit value. The control section 5 then makes the storage portion 6 change the limit value in the width detection data D1 such that the correction target range E1 has an upper limit value of 102. In this way, it is possible to increase the upper limit value of the correction target range E1 to adapt to the sensor value's tendency to be larger than the center value.

On the other hand, when the second proportion is higher than the reference proportion F1 (Step #3, Yes), the control section 5 calculates the average value of the negative differences (Step #10). The control section 5 then checks whether or not the average value of the negative differences is equal to or larger than the prescribed reference deviation F2 (Step #11). When it is smaller than the reference deviation F2 (Step #11, No), the control section 5 ends the procedure without correcting the correction target range E1 (from Step #4 to End). When the deviation from the center value is so small as to fall below the reference deviation, erroneous detection of sheet width is unlikely, and therefore the range does not need to be corrected. On the other hand, when the average value of the negative differences is equal to or larger than the reference deviation F2 (Step #11, Yes), the control section 5 determines a new limit value at the border with the range that is contiguous with the correction target range E1 on the one-step smaller sensor value side (i.e., on the lower limit side) (Step #12).

The control section 5 then checks whether or not the absolute value of the difference between the center value of the correction target range E1 with the new limit value applied to it and the center value of the range contiguous with it on the side to which the limit value is moved (i.e., the lower side) is equal to or smaller than a prescribed correction restriction value (Step #13). When the absolute value is equal to or smaller than the correction restriction value (Step #13, Yes), the control section 5 ends the procedure without correcting the correction target range E1 (from Step #4 to End).

When the absolute value is not equal to or smaller than the correction restriction value (Step #13, No), the control section 5 makes the storage portion 6 change the limit value in the width detection data D1 such that the lower limit value of the correction target range E1 equals the new limit value (Step #14). This ends the procedure (End).

Specifically, the control section 5 determines as the new lower limit value of the correction target range E1 one-half of the sum of the value obtained by subtracting the absolute value of the average value of the negative differences from the current center value of the correction target range E1 and the center value of the range that is contiguous with the correction target range E1 on the one-step smaller sensor value side.

Figure 10:
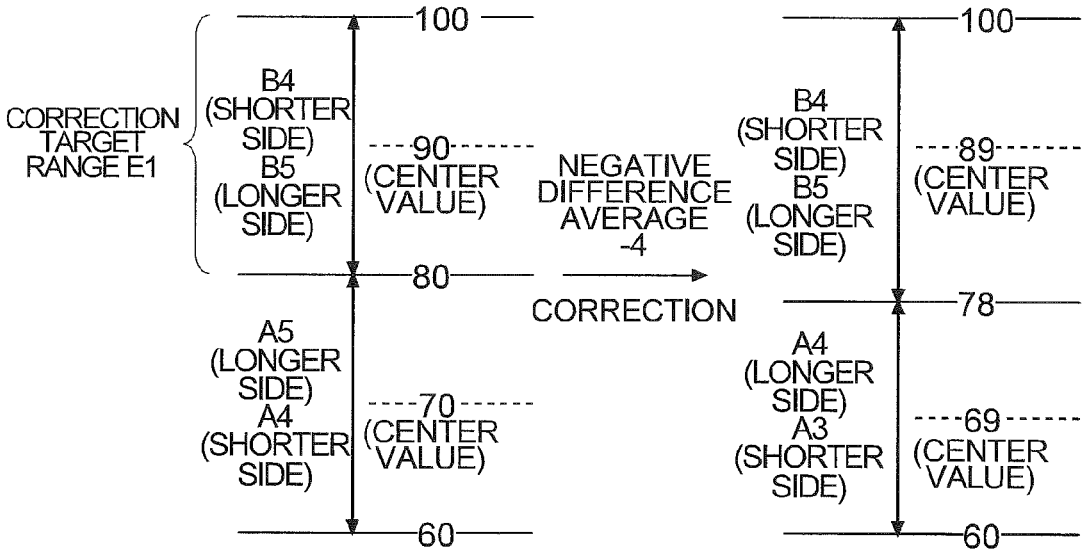
FIG. 10 is a diagram showing one example of shifting of a limit value according to one embodiment.

This will now be described with reference to FIG. 10. In the example shown in FIG. 10, the correction target range E1 is the range corresponding to B4 (shorter side) and B5 (longer side). It is assumed that the correction target range E1 has a sensor value of 80 as the lower limit value, a sensor value of 100 as the upper limit value, and a center value of 90, and that the average value of the negative differences is calculated as −4. First, the control section 5 subtracts the absolute value of the average value of the negative differences, 4, from the current center value of the correction target range E1, 90, to obtain 86. Subsequently, the control section 5 adds up the obtained value, 86, and the center value of the range (shorter side of A4, longer side of A5) contiguous with the correction target range E1 on the one-step smaller sensor value side, 70, to obtain 156. The control section 5 then halves the sum to determine the result, 78, as the corrected limit value. The control section 5 then makes the storage portion 6 change the limit value in the width detection data D1 such that the correction target range E1 has a lower limit value of 78. In this way, it is possible to decrease the lower limit value of the correction target range E1 to adapt to the sensor value's tendency to be smaller than the center value.

On reaching the end of the procedure, the control section 5 may delete, from the stored sensor value data D2, the sensor values corresponding to the sheet width associated with the correction target range E1 (the sheet width that has been detected a natural number times a predetermined number of times) and reset to zero the number of times (cumulative number of times) that the sheet width (sheet size) associated with the correction target range E1 has been detected.

While the above description deals with correction of the width detection data D1 for the manual sheet feeding device 1*a*, in the multifunction peripheral 100 (sheet feeding device 1) according to the embodiment, stored sensor value data D2 is stored in the storage portion 6 also for each of the cassette sheet feeding device 1*b* and the document transport portion 1*c*. The control section 5 performs the procedure in the flow charts in FIGS. 7 and 8 also for each of the cassette sheet feeding device 1*b* and the document transport portion 1*c*. Thereby, for each of the cassette sheet feeding device 1*b* and the document transport portion 1*c*, the width detection data D1 is corrected to cope with wear in the variable resistor 8.

The example described above deals with a configuration where a first proportion, a second proportion, and a reference proportion F1 are determined to decide whether or not to correct a limit value. Instead, a configuration is also possible where the average value of all the sensor values resulting from detection performed for the last predetermined number of times before now is calculated, and based on whether or not the average value is equal to or larger than a reference deviation F2, whether or not to correct a limit value is decided (thereby skipping calculation and processing involving proportions).

In that case, when the average value of all sensor values for the last predetermined number of times is positive and in addition it is equal to or larger than the reference deviation F2, the control section 5 determines as the new upper limit value of the correction target range E1 one-half of the sum of the value obtained by adding the average value to the current center value of the correction target range E1 and the center value of the range, in the width detection data D1, that is contiguous with the correction target range E1 on the one-step larger sensor value side. On the other hand, when the average value of all sensor values for the last predetermined number of times is negative and in addition the absolute value of the average value is equal to or larger than the reference deviation F2, the control section 5 determines as the new lower limit value of the correction target range E1 one-half of the sum of the value obtained by subtracting the absolute value of the average value from the current center value of the correction target range E1 and the center value of the range, in the width detection data D1, that is contiguous with the correction target range E1 on the one-step smaller sensor value side.

As described above, according to one embodiment of the present disclosure, a sheet feeding device 1 includes: cursors which are arranged on a sheet tray 11 for placing a sheet on and which are slidable to abut opposite edges of the placed sheet to regulate the position of the sheet; a sensor portion 7 which includes a variable resistor 8 and which outputs a voltage commensurate with the position of the cursors; a storage portion 6 for storing width detection data D1 in which are defined, for different widths of standard sheets as detection targets respectively, ranges of a sensor value which is a value commensurate with the level of the output of the sensor portion 7 and which is obtained based on the output of the sensor portion 7; and a control portion 5 which processes the output voltage of the sensor portion 7 to obtain the sensor value; which performs sheet width detection to detect placement of a sheet of a width corresponding to one of the ranges to which the sensor value belongs; which makes the storage portion 6 store the sensor value obtained during the sheet width detection; which takes as a correction target range E1 one of the ranges corresponding to, out of different standard sheet widths, the sheet width that has been detected a number of times equal to a natural number times a predetermined number of times; which calculates the difference between the sensor value as actually obtained and the center value of the correction target range E1; and which corrects a limit value (an upper or lower limit value) of the correction target range E1 at the border with another range.

Through repeated sliding of the cursors, components inside the variable resistor 8 wear. Accordingly, the sensor portion 7 (variable resistor 8) changes its output characteristics, its output voltage value increasing or decreasing from the initial value. The changing output characteristics can be traced to correct the width detection data D1. Specifically, the range of the sensor value for each sheet width can be shifted little by little. In that way, the limit values of the range of the sensor value for each sheet width defined in the width detection data D1 can by corrected automatically according to how long the sheet feeding device 1 has been used. This makes it possible to detect the width of placed sheets accurately even after a long period of use. In addition, no separate sensor for sheet width detection, such as an image sensor, needs to be arranged. This allows accurate sheet width detection with no increase in the production cost of the sheet feeding device 1.

The control portion 5 calculates differences by subtracting the current center value of the correction target range E1 from the sensor values obtained when placement of a sheet of the width corresponding to the correction target range E1 was detected for the last predetermined number of times respectively, and calculates the average value of all or part of the calculated differences. When the average value of the differences is positive, the control portion 5 performs correction by taking, as the upper limit value of the correction target range E1, one-half of the sum of the value obtained by adding the average value of the differences to the current center value of the correction target range E1 and the center value of the range, in the width detection data D1, that is contiguous with the correction target range E1 on the one-step larger sensor value side. When the average value of the differences is negative, the control portion 5 performs correction by taking, as the lower limit value of the correction target range E1, one-half of the sum of the value obtained by subtracting the average value of the differences from the current center value of the correction target range E1 and the center value of the range, in the width detection data D1, that is contiguous with the correction target range E1 on the one-step smaller sensor value side.

In this way, a limit value (an upper of lower limit value) of the correction target range E1 can be shifted to suit the actual condition of the output of the sensor portion 7 (variable resistor 8). It is thus possible to shift the ranges of the sensor value corresponding to different sheet widths to follow the actual change in the output of the sensor portion 7, and thus to correct the width detection data D1 properly.

The sensor value does not always coincide with the center value each time sheets of the same size are placed; even the sensor value itself may vary. However, so long as there is only a small difference between the number of times that the sensor value is detected being larger than the center value and the number of times that the sensor value is detected being smaller than the center value, the average sensor value is considered to be close to the center value. There is then low necessity to correct a range defined in the width detection data D1. Even when the sensor value varies within a range, as tending to be larger or smaller than the center value, so long as the differences from the center value are small, there is low necessity to correct the range immediately.

Therefore, the control portion 5 calculates differences by subtracting the current center value of the correction target range E1 from the sensor values obtained when placement of a sheet of the width corresponding to the correction target range E1 was detected for the last predetermined number of times respectively. When a first proportion, which is calculated by dividing the number of positive differences by the predetermined number of times, is higher than a prescribed reference proportion E1, and in addition the average value of the positive differences is equal to or larger than a prescribed reference deviation F2, the control portion 5 performs correction by taking, as the upper limit value of the correction target range E1, one-half of the sum of the value obtained by adding the average value of the positive differences to the current center value of the correction target range E1 and the center value of the range, in the width detection data D1, that is contiguous with the correction target range E1 on the one-step larger sensor value side. When a second proportion, which is calculated by dividing the number of negative differences by the predetermined number of times, is higher than the prescribed reference proportion F1, and in addition the absolute value of the average value of the negative differences is equal to or larger than the prescribed reference deviation F2, the control portion 5 performs correction by taking, as the lower limit value of the correction target range E1, one-half of the sum of the value obtained by subtracting the absolute value of the average value of the negative differences from the current center value of the correction target range E1 and the center value of the range, in the width detection data D1, that is contiguous with the correction target range E1 on the one-step smaller sensor value side. When the first proportion is not equal to or higher than the reference proportion F1 and in addition the average value of the positive differences is lower than the reference deviation F2, or when the second proportion is not equal to or higher than the reference proportion F1 and in addition the absolute value of the average value of the negative differences is lower than the reference deviation F2, the control section 5 does not correct any limit value of the correction target range E1.

In this way, only when it is recognized that sensor values are distributed unevenly within the correction target range E1 (tending to be larger or smaller than the center value), and in addition the actual sensor value is frequency deviated from the center value, the correction target range E1 is corrected. It is thus possible to correct ranges in the width detection data D1 only when necessary. It is thus possible to gradually change the ranges corresponding to different sheet widths defined in the width detection data D1 so as to adapt to slow change across the ages.

When the absolute value of the difference between the center value of the correction target range E1 and the center value of the range contiguous with the correction target range E1 on the side thereof to which a limit value is moved is equal to or smaller than a prescribed correction restriction value, the control portion 5 does not perform the correction. It is thus possible to prevent a range of the sensor value corresponding to a given sheet width from becoming excessively narrow as a result of a limit value being moved for correction.

On the other hand, a multifunction peripheral 100 (image forming apparatus) includes a sheet feeding device according to one embodiment of the present disclosure. It is thus possible to provide an image forming apparatus that can detect the width of placed sheets correctly even after a long cumulative period of use. It is then possible to provide an image forming apparatus that executes jobs properly based on the detected accurate sheet width. It is also possible to eliminate the need for a separate sensor for sheet width detection, such as an image sensor, and thus to reduce the production cost of an image forming apparatus.

The embodiment of the present disclosure specifically described above is not meant to limit the scope of the present disclosure. The present disclosure can be implemented with any modifications made within the spirit of the present disclosure.

What is claimed is:

1. A sheet feeding device, comprising:

cursors arranged on a sheet tray on which a sheet is placed, the cursors being slidable to abut opposite edges of the placed sheet to regulate position of the sheet;

a sensor portion including a variable resistor and outputting a voltage commensurate with position of the cursors;

a storage portion for storing width detection data in which ranges, for different standard sheet widths respectively, of a sensor value are defined, the sensor value being a value commensurate with a level of an output of the sensor portion and obtained based on the output of the sensor portion; and a control portion which processes an output voltage of the sensor portion to obtain the sensor value, which performs sheet width detection to detect placement of a sheet of a width corresponding to one of the ranges to which the sensor value belongs, which makes the storage portion store the sensor value obtained during the sheet width detection, which takes as a correction target range one of the ranges corresponding to, out of different standard sheet widths, a sheet width that has been detected a number of times equal to a natural number times a predetermined number of times, which calculates a difference between the sensor value as actually obtained and a center value of the correction target range, and which corrects an upper or lower limit value of the correction target range at a border with another range.

2. The sheet feeding device of claim 1, wherein the control portion calculates differences by subtracting a current center value of the correction target range from sensor values obtained when placement of a sheet of the width corresponding to the correction target range was detected for a last predetermined number of times respectively, and calculates an average value of all or part of the calculated differences, when the average value of the differences is positive, the control portion performs correction by taking, as the upper limit value of the correction target range, one-half of a sum of a value obtained by adding the average value of the differences to the current center value of the correction target range and a center value of a range, in the width detection data, that is contiguous with the correction target range on a one-step larger sensor value side, and when the average value of the differences is negative, the control portion performs correction by taking, as the lower limit value of the correction target range, one-half of a sum of a value obtained by subtracting the average value of the differences from the current center value of the correction target range and a center value of a range, in the width detection data, that is contiguous with the correction target range on a one-step smaller sensor value side.

3. The sheet feeding device of claim 1, wherein the control portion calculates differences by subtracting a current center value of the correction target range from sensor values obtained when placement of a sheet of the width corresponding to the correction target range was detected for a last predetermined number of times respectively, when a first proportion, which is calculated by dividing a number of positive differences out of the differences by the predetermined number of times, is higher than a prescribed reference proportion, the control portion performs correction by taking, as the upper limit value of the correction target range, one-half of a sum of a value obtained by adding an average value of the positive differences to the current center value of the correction target range and a center value of a range, in the width detection data, that is contiguous with the correction target range on a one-step larger sensor value side, and when a second proportion, which is calculated by dividing a number of negative differences out of the differences by the predetermined number of times, is higher than the prescribed reference proportion, the control portion performs correction by taking, as the lower limit value of the correction target range, one-half of a sum of a value obtained by subtracting an absolute value of an average value of the negative differences from the current center value of the correction target range and a center value of a range, in the width detection data, that is contiguous with the correction target range on a one-step smaller sensor value side.

4. The sheet feeding device of claim 3, wherein when neither the first proportion nor the second proportion is equal to or higher than the reference proportion, the control portion does not correct any limit value of the correction target range.

5. The sheet feeding device of claim 1, wherein the control portion calculates differences by subtracting a current center value of the correction target range from sensor values obtained when placement of a sheet of the width corresponding to the correction target range was detected for a last predetermined number of times respectively, when an average value of positive differences out of the differences is equal to or larger than a prescribed reference deviation, the control portion performs correction by taking, as the upper limit value of the correction target range, one-half of a sum of a value obtained by adding the average value of the positive differences to the current center value of the correction target range and a center value of a range, in the width detection data, that is contiguous with the correction target range on a one-step larger sensor value side, and when an absolute value of an average value of negative differences out of the differences is equal to or larger than the prescribed reference deviation, the control portion performs correction by taking, as the lower limit value of the correction target range, one-half of a sum of a value obtained by subtracting the absolute value of the average value of the negative differences from the current center value of the correction target range and a center value of a range, in the width detection data, that is contiguous with the correction target range on a one-step smaller sensor value side.

6. The sheet feeding device of claim 5, wherein when either the average value of the positive differences or the absolute value of the average value of the negative differences is smaller than the reference deviation, the control portion does not correct any limit value of the correction target range.

7. The sheet feeding device of claim 1, wherein when an absolute value of a difference between the center value of the correction target range and a center value of a range contiguous with the correction target range on a side thereof to which a limit value is moved is equal to or smaller than a prescribed correction restriction value, the control portion does not perform the correction.

8. An image forming apparatus comprising the sheet feeding device of claim 1.

9. A sheet feeding method, comprising:

outputting from a sensor portion a voltage commensurate with position of cursors provided on a sheet tray to be slidable to abut opposite edges of a placed sheet to regulate position of the sheet;

storing width detection data in which are defined ranges, for different standard sheet widths respectively, of a sensor value obtained based on an output of the sensor portion;

obtaining the sensor value by processing an output voltage of the sensor portion;

performing sheet width detection to detect that a sheet of a width corresponding to the range to which the sensor value belongs is placed;

storing the sensor value obtained during the sheet width detection;

taking as a correction target range one of the ranges corresponding to a sheet width that has been detected a number of times equal to a natural number times a predetermined number of times;

calculating a difference between the sensor value as actually obtained and a center value of the correction target range; and correcting an upper or lower limit value of the correction target range at a border with another range.

* * * * *